US011225809B2

(12) United States Patent
Choi

(10) Patent No.: US 11,225,809 B2
(45) Date of Patent: Jan. 18, 2022

(54) CANOPY TENT

(71) Applicant: CAMPVALLEY (XIAMEN) CO., LTD., Fujian (CN)

(72) Inventor: Kwanjun Choi, Gyeongsangnam-Do (KR)

(73) Assignee: CAMPVALLEY (XIAMEN) CO., LTD., Fujian (CN)

( * ) Notice: Subject to any disclaimer, the term of this patent is extended or adjusted under 35 U.S.C. 154(b) by 0 days.

(21) Appl. No.: 16/765,862

(22) PCT Filed: Jun. 4, 2019

(86) PCT No.: PCT/CN2019/089967
§ 371 (c)(1),
(2) Date: May 20, 2020

(87) PCT Pub. No.: WO2019/242497
PCT Pub. Date: Dec. 26, 2019

(65) Prior Publication Data

US 2020/0299990 A1 Sep. 24, 2020

(30) Foreign Application Priority Data

Jun. 21, 2018 (CN) ..... 201820959346.8

(51) Int. Cl.
*E04H 15/50* (2006.01)
*E04H 15/46* (2006.01)

(52) U.S. Cl.
CPC ..... *E04H 15/50* (2013.01); *E04H 15/46* (2013.01)

(58) Field of Classification Search
CPC ..... E04H 15/48; E04H 15/50
See application file for complete search history.

(56) References Cited

U.S. PATENT DOCUMENTS 4,256,129 A * 3/1981 Gilsenan ..... E04H 15/50 135/143
5,490,532 A * 2/1996 Mallookis ..... E04H 15/50 135/114
5,499,646 A * 3/1996 Lee ..... E04H 15/28 135/121
5,701,923 A * 12/1997 Losi, Jr. ..... E04H 15/322 135/131

(Continued)

FOREIGN PATENT DOCUMENTS

CN 207245328 U * 4/2018
WO WO-2017028659 A1 * 2/2017 ..... E04H 15/50

*Primary Examiner* — Noah Chandler Hawk
(74) *Attorney, Agent, or Firm* — Leong C. Lei

(57) ABSTRACT

A canopy tent includes a plurality of vertical rods. Top ends of the vertical rods are connected to top rods, respectively. An inner end of each top rod is pivotally connected to a top hub located at a center of the canopy tent. Each top rod includes an inner rod and an outer rod that are pivotally connected to each other at a middle portion of each top rod. A side rod assembly that can be unfolded or folded inwardly is connected between every adjacent two of the vertical rods. A push-pull assembly is provided under the center of the canopy tent. The push-pull assembly includes a plurality of push-pull rods that are pivotally connected to lower ends of the inner rods of the top rods, respectively. A lower end of each push-pull rod is pivotally connected to a connecting base located under the top hub.

7 Claims, 11 Drawing Sheets

(56) References Cited

U.S. PATENT DOCUMENTS

| | | | | |
|---|---|---|---|---|
| 6,581,617 | B2 * | 6/2003 | Ham | E04H 15/28 135/135 |
| 7,350,532 | B2 * | 4/2008 | Wu | E04H 15/48 135/135 |
| 10,273,710 | B2 * | 4/2019 | Yang | E04H 15/44 |
| 10,669,738 | B2 * | 6/2020 | Yang | E04H 15/48 |
| 2005/0097829 | A1 * | 5/2005 | Seo | E04H 15/50 52/79.1 |
| 2018/0298631 | A1 * | 10/2018 | Yang | E04H 15/46 |
| 2019/0234102 | A1 * | 8/2019 | Lu | E04H 15/46 |
| 2019/0277053 | A1 * | 9/2019 | Yang | E04H 15/60 |

* cited by examiner

CANOPY TENT

BACKGROUND OF THE INVENTION

1. Technical Field of the Invention

The present invention relates to a tent for traveling or camping, and more particularly to a canopy tent that can be quickly unfolded or folded.

2. Description of the Prior Art

FIG. 1 illustrates a conventional tent. The tent frame includes a plurality of vertical rods 1'. The vertical rods 1' may be telescopic rods. The tops of the vertical rods 1' are connected to top rods 21' that form a top frame 2' of the tent. As shown in FIG. 1, the tent frame includes four vertical rods 1'. The top frame 2' includes four top rods 21' and a connecting hub 22' for connecting the top rods 21'. The inner ends of the top rods 21' are connected to the connecting hub 22'. The top rods 21' can be folded downwardly. A side rod assembly that can be unfolded or folded inwardly is connected between every adjacent two of the vertical rods 1'. Each side rod assembly includes at least two link rod units 40' that are hinged to each other. Each link rod unit 40' includes two link rods 41' that are hinged to each other and have an "X" shape when unfolded. As shown in FIG. 1, each side rod assembly includes three link rod units. Each link rod unit 40' includes two cross-linked link rods 41'. A top fixed seat 11' is installed on the top end of each vertical rod 1'. An outer end of each top rod 21' is connected to the top fixed seat 11'. A sliding seat 12' is provided under the top fixed seat 11'. The sliding seat 12' can slide along the vertical rod 1' to be positioned on the vertical rod 1'. In each side rod assembly, free outer ends of the link rods 41' at two outer sides are pivotally connected to the top fixed seats 11' and the sliding seats 12', respectively. Thus, the cross-linked side rod assembly between every two vertical rods 1' can drive the two vertical rods 1' to expand or retract.

For the above-mentioned tent, when the tent is to be folded, the sliding seat 12' on each of the vertical rods 1' is first released from positioning, and then the vertical rods 1' are retracted inwardly, and each side rod assembly 40' between every adjacent two of the vertical rods 1' are retracted in a cross manner. Due to the large size of the tent, during operation, it is necessary to sequentially move the sliding seats 12' down on the four vertical rods 1', so that the vertical rods 1' can be retracted inwardly. This requires at least two persons to operate the tent, and the operation is time-consuming and labor-intensive. If there is only one person, the operation difficulty and operation time are greatly increased. When the tent is unfolded, it is also necessary to unfold the vertical rods 1' in sequence, and each link rod unit 40' of the side rod assembly between every adjacent two of the vertical rods 1' unfolds. Because the sides of the tent frame are unfolded or folded independently and cannot be linked, which consumes time and effort in operation.

The existing tent frame cannot be quickly unfolded and folded. The operation is time-consuming, labor-intensive and difficult, which causes great inconvenience in use.

SUMMARY OF THE INVENTION

The primary object of the present invention is to provide a canopy tent. The canopy tent may quickly unfold or fold, thus conserving time and effort during operation. A single person may complete the unfolding and folding actions.

In order to achieve the above object, the present invention adopts the following technical solutions.

A canopy tent comprises a plurality of vertical rods. Top ends of the vertical rods are connected to top rods, respectively. An inner end of each top rod is pivotally connected to a top hub located at a center of the canopy tent. Each top rod comprises an inner rod and an outer rod that are pivotally connected to each other at a middle portion of each top rod. A side rod assembly that can be unfolded or folded inwardly is connected between every adjacent two of the vertical rods. A push-pull assembly is provided under the center of the canopy tent. The push-pull assembly includes a plurality of push-pull rods that are pivotally connected to lower ends of the inner rods of the top rods, respectively. A lower end of each push-pull rod is pivotally connected to a connecting base located under the top hub.

Preferably, the push-pull assembly further includes a pull rod that is inserted through and retained at a middle portion of the connecting base.

Preferably, the top rods are folded or unfolded by pulling the pull rod down or by pushing the pull rod up, so that the vertical rods are retracted inwardly or expanded outwardly, and the side rod assemblies between the vertical rods are folded or unfolded.

Preferably, a lower end of the pull rod is provided with a cover or a curved handle.

Preferably, the connecting base is provided with pivot notches corresponding to the push-pull rods, and the lower ends of the push-pull rods are pivotally connected to the pivot notches, respectively.

Preferably, a fixed seat is installed on the top end of each vertical rod. Each vertical rod is provided with a sliding seat that is slidable along the vertical rod. An outer end of each top rod is pivotally connected to an inner side of the fixed seat. Each side rod assembly includes at least two link rod units. Each link rod unit includes two link rods that are hinged to each other and have an "X" shape when unfolded. Free outer ends of the link rods at two outer sides of each side rod assembly are hingedly connected to the fixed seats and the sliding seats of the adjacent vertical rods, respectively.

Preferably, an auxiliary rod is provided under the outer rod of each top rod. An upper end of the auxiliary rod is pivotally connected to the outer rod, and a lower end of the auxiliary rod is pivotally connected to an inner side of the sliding seat.

Preferably, the inner rod and the outer rod are pivotally connected by a one-way connecting member or a connecting plate, so that the inner rod and the outer rod can be unfolded and folded downward at the middle portion of each top rod.

Preferably, the vertical rods are telescopic rods.

The canopy tent of the present invention is provided with the push-pull assembly. The push-pull assembly is configured to be pulled down or pushed up to drive the connecting base at the center of the canopy tent to be pulled down or pushed up, so as to fold the push-pull rods downwardly, inwardly or unfold the push-pull rods upwardly. Pulling force and pushing force are generated from the top to drive the vertical rods to retract inwardly or expand outwardly. At the same time, the side rod assemblies connected between the vertical rods can be folded or unfolded, so that the overall canopy tent can be folded or unfolded. The canopy tent may quickly unfold or fold, thus conserving time and effort during operation. A single person may complete the unfolding and folding actions.

DETAILED DESCRIPTION OF THE PREFERRED EMBODIMENTS

Embodiments of the present invention will now be described, by way of example only, with reference to the accompanying drawings.

Figure 1:
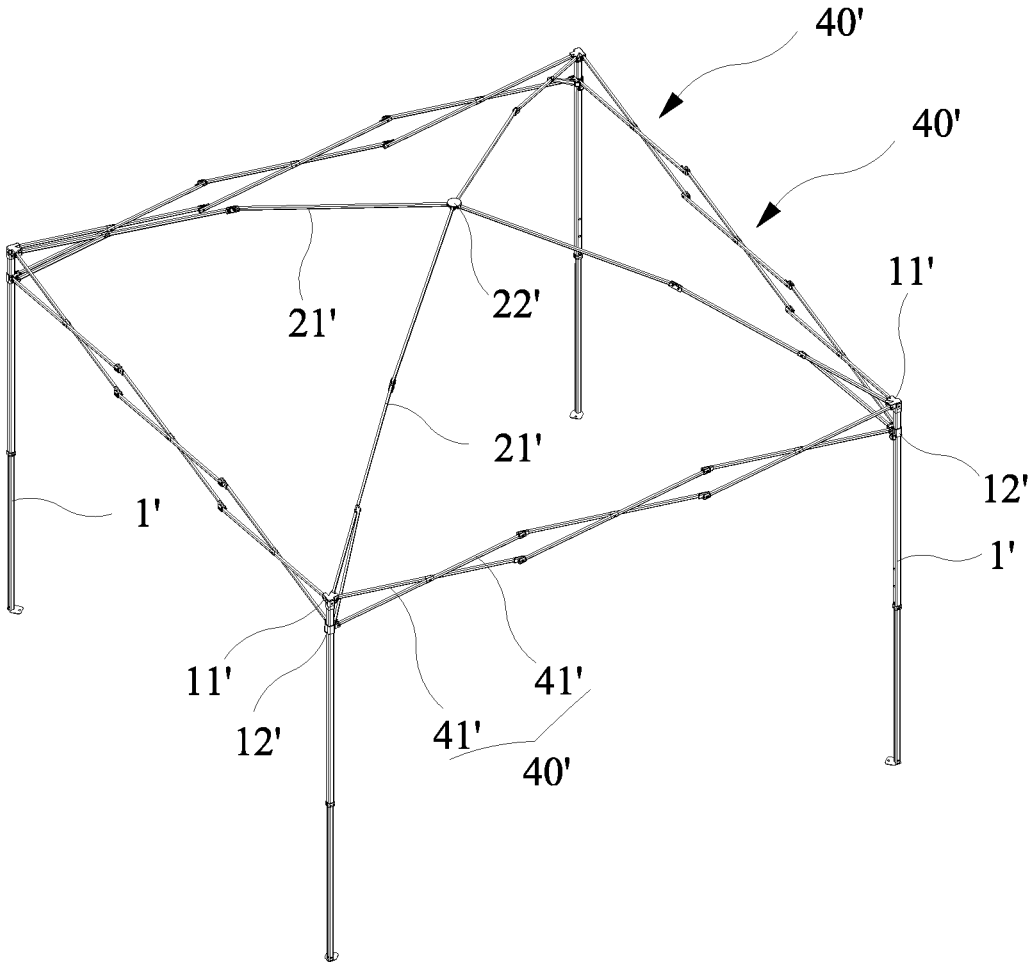
FIG. 1 (PRIOR ART)
FIG. 1 is a schematic view of a conventional tent support.
Figure 2:
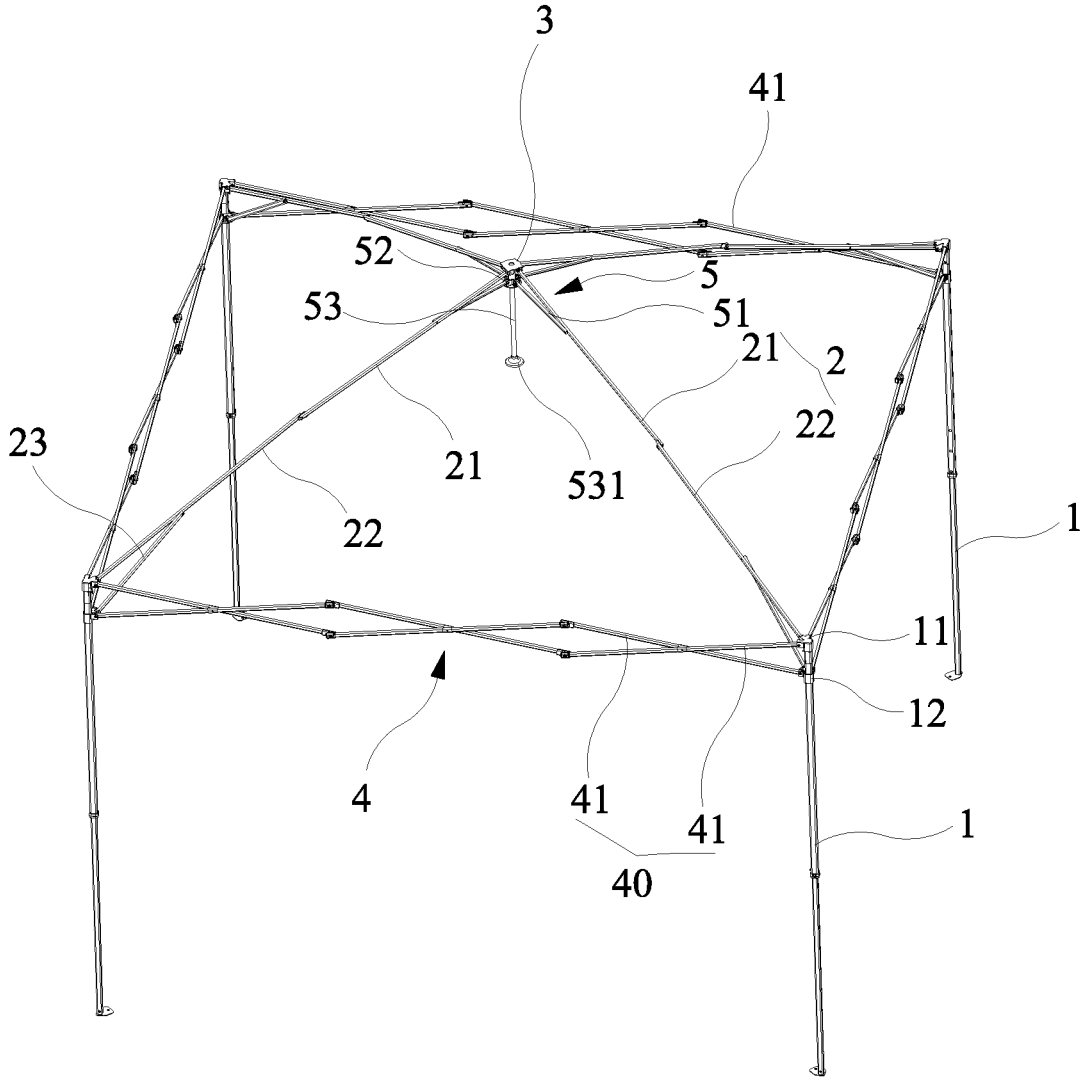
FIG. 2 is a perspective view of the present invention in an unfolded state.
Figure 3:
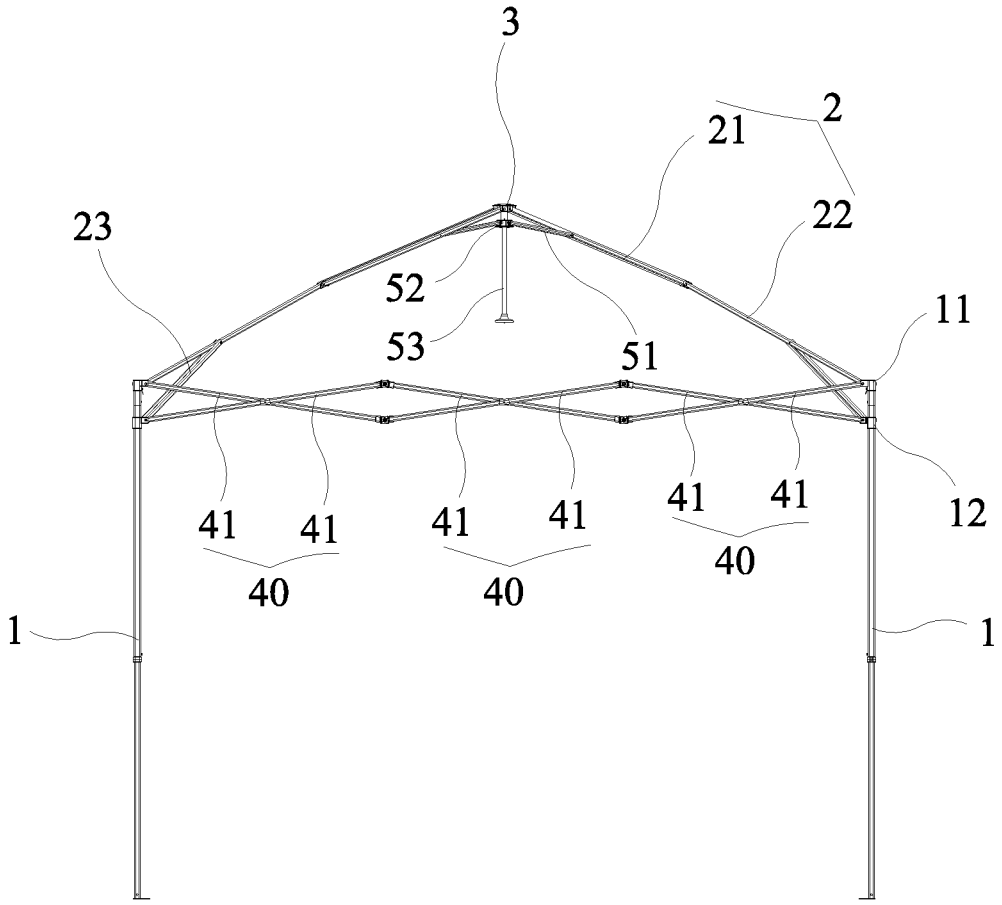
FIG. 3 is a side view of FIG. 2.

The present invention discloses a canopy tent, as shown in FIG. 2 and FIG. 3, comprising a plurality of vertical rods 1. The vertical rods 1 are telescopic rods. Top ends of the vertical rods 1 are connected to top rods 2, respectively. An inner end of each top rod 2 is pivotally connected to a top hub 3 located at the center of the canopy tent. The top rods are arranged radially to form a top frame. In this embodiment, a fixed seat 11 is installed on the top end of each vertical rod 1. An outer end of each top rod 2 is pivotally connected to an inner side of the fixed seat 11. Each vertical rod 1 is provided with a sliding seat 12 that is slidable along the vertical rod 1. Each top rod 2 comprises an inner rod 21 and an outer rod 22 that are pivotally connected to each other at a middle portion of each top rod 2. The inner rod 21 and the outer rod 22 may be pivotally connected by a one-way connecting member or a connecting plate, so that the inner rod 21 and the outer rod 22 can be unfolded and folded downward at the middle portion of each top rod 2.

A side rod assembly 4 that can be unfolded or folded inwardly is connected between every adjacent two of the vertical rods 1. Each side rod assembly 4 includes at least two link rod units 40. In this embodiment, each side rod assembly 4 includes three two link rod units 40. Each link rod unit 40 includes two link rods 41 that are hinged to each other and have an "X" shape when unfolded. In addition, free outer ends of the link rods 41 at two outer sides of each side rod assembly are hingedly connected to the fixed seats 11 and the sliding seats 12 of the adjacent vertical rods 1, respectively. Thus, the cross-linked side rod assembly 4 between every two vertical rods 1 can drive the two vertical rods 1 to expand or retract together, and adjacent two side rod assemblies 4 can be simultaneously moved by the sliding seats 12 on the vertical rods 1. An auxiliary rod 23 is provided under the outer rod 22 of each top rod 2. An upper end of the auxiliary rod 23 is pivotally connected to the outer rod 22. A lower end of the auxiliary rod 23 is pivotally connected to an inner side of the sliding seat 12. The auxiliary rod 23 provides a further auxiliary support for the top rod 2, and the top rod 2 is indirectly connected to the sliding seat 12.

Figure 4:
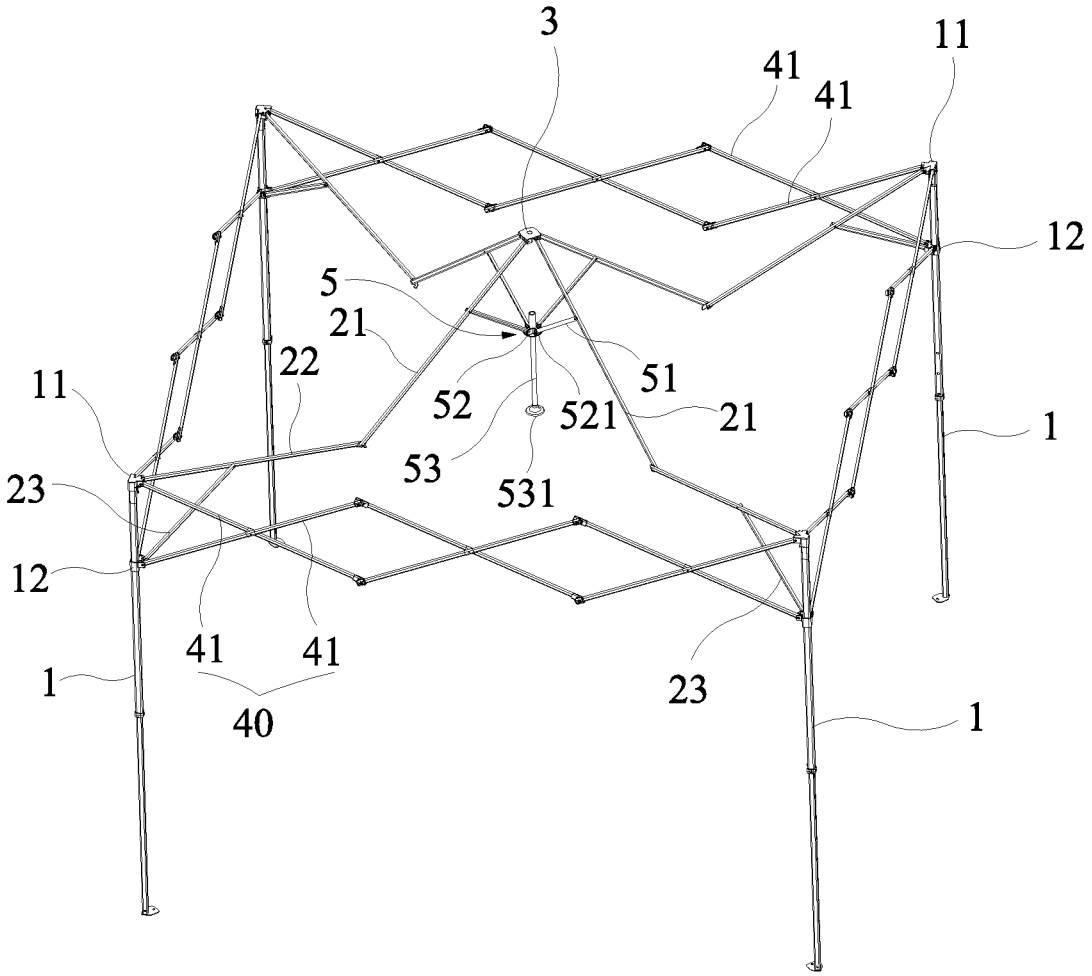
FIG. 4 is a schematic view of the present invention to be folded.
Figure 5:
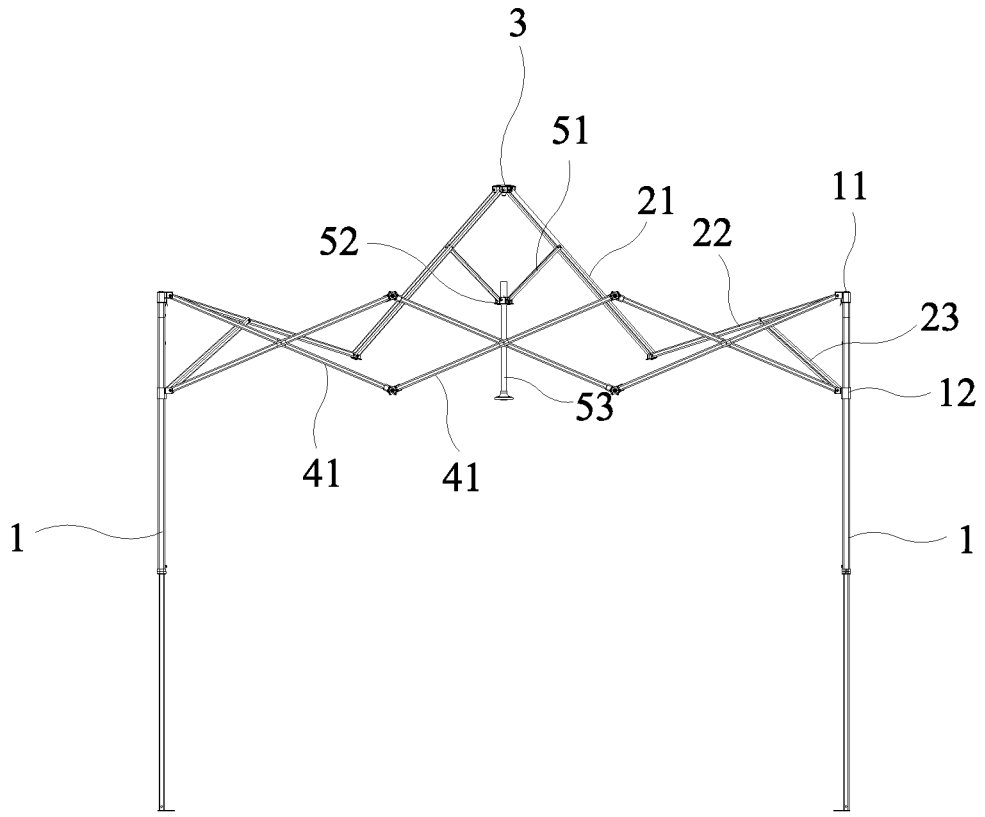
FIG. 5 is a side view of FIG. 4.

In the present invention, a push-pull assembly 5 is disposed under the center of the canopy tent. As shown in FIG. 2 and FIG. 4, the push-pull assembly 5 includes a plurality of push-pull rods 51 that are pivotally connected to lower ends of the inner rods 21 of the top rods 2, respectively. The push-pull rods 51 correspond in number to the inner rods 21 of the top rods 2, and are located under the inner sides of the inner rods 21 of the top rods 2. A lower end of each push-pull rod 51 is pivotally connected to a connecting base 52 located under the top hub 3. The connecting base 52 is provided with pivot notches 521 corresponding to the push-pull rods 51. The lower ends of the push-pull rods 51 are pivotally connected to the pivot notches 521, respectively. Furthermore, the push-pull assembly 5 further comprises a pull rod 53 that is inserted through and retained at a middle portion of the connecting base 52. The pull rod 53 can facilitate the user unable to touch the connecting base 51 to perform a push-pull action in the case that the height of the canopy tent is too high. The push-pull rod 53 can be pushed up or pulled down to facilitate the operation. A lower end of the pull rod 53 is provided with a cover 531 or a curved handle for easy use. By applying a force to the pull rod 53, each top rod 2 can be folded or unfolded by pulling the pull rod 53 down or by pushing the pull rod 53 up, so that the vertical rods 1 can be retracted inwardly or expanded outward, and the side rod assemblies 4 between the vertical rods 1 are linked to be retracted or expanded simultaneously.

Figure 6:
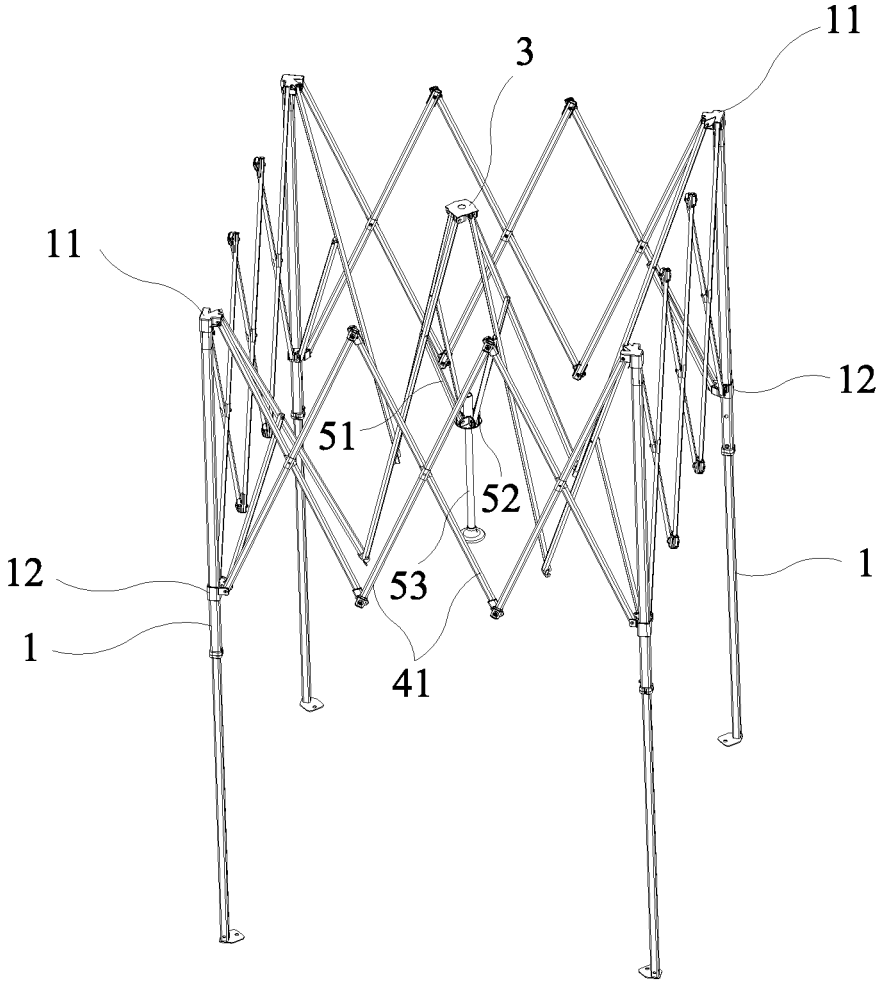
FIG. 6 is a schematic view of the present invention in a half-folded state.
Figure 7:
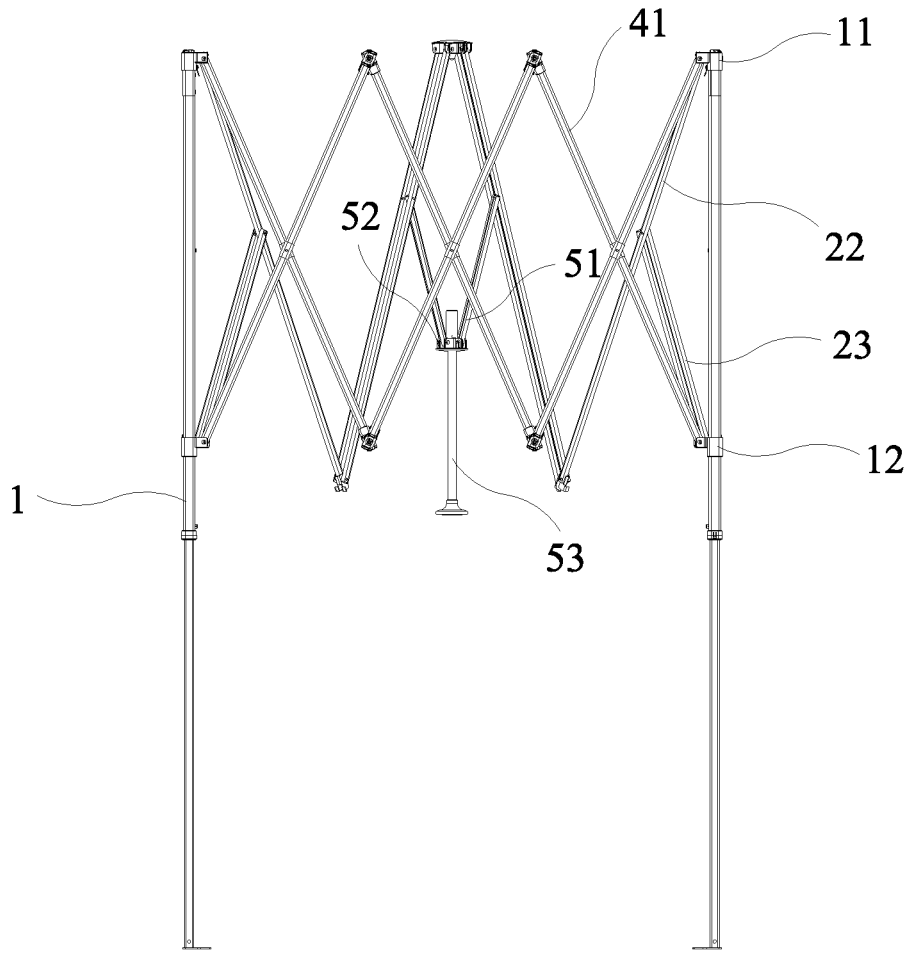
FIG. 7 is a side view of FIG. 6.
Figure 10:
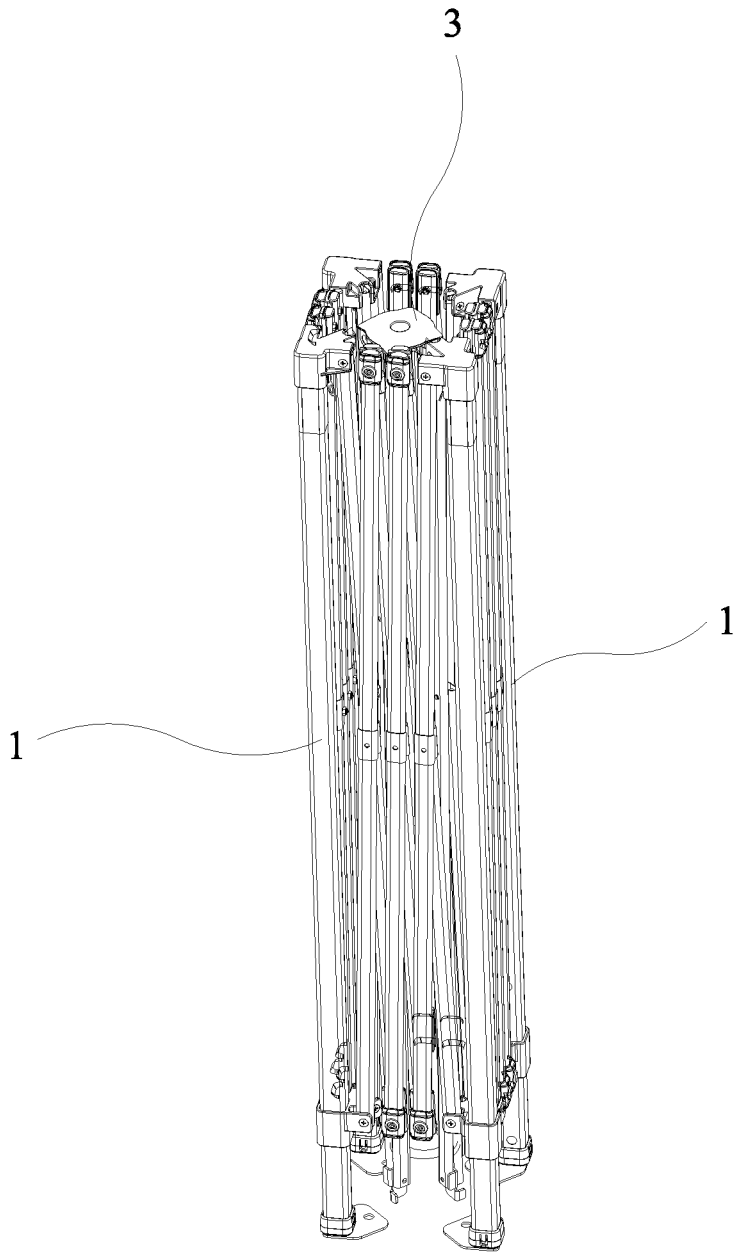
FIG. 10 is a schematic view of the present invention in a fully-folded state.
Figure 11:
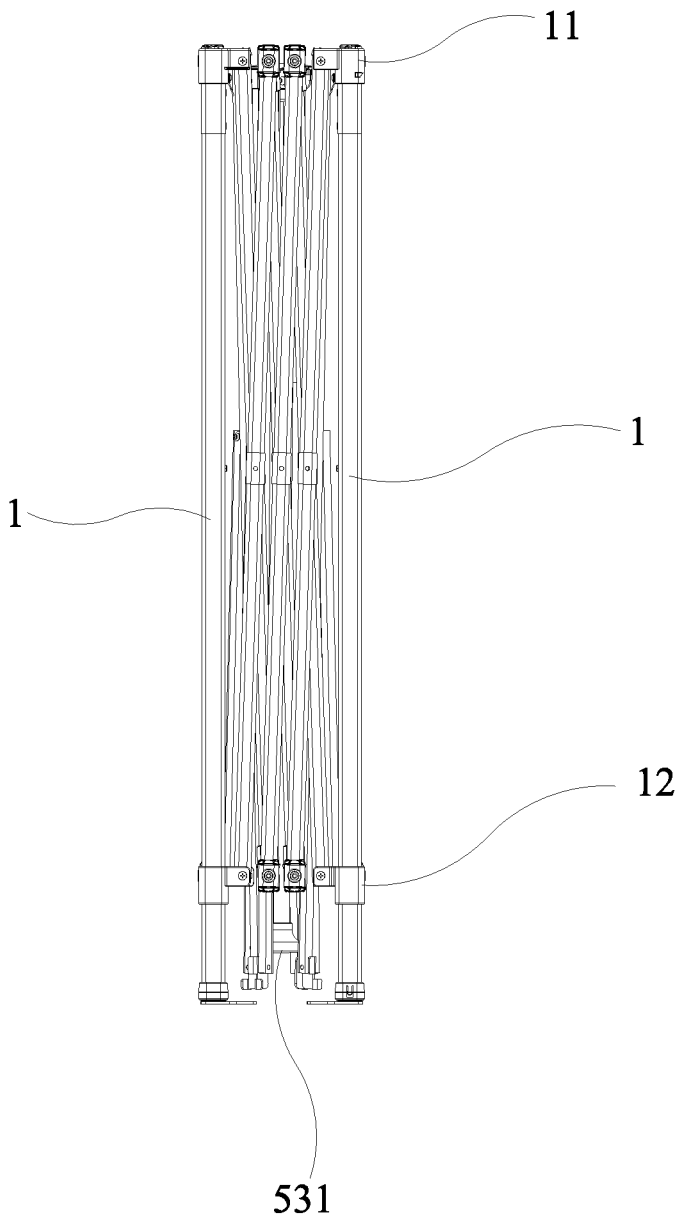
FIG. 11 is a side view of FIG. 10.

In use, as shown in FIGS. 2 to 11, when the canopy tent needs to be folded, the sliding seat 12 on each vertical rod 1 is released. In the canopy tent, the connecting base 52 is pulled down. If the canopy tent is provided with the pull rod 53, the pull rod 53 is pulled down. Each push-pull rod 51 is driven by the connecting base 52 that is pulled down. After the push-pull rod 51 is pulled down to leave the equilibrium position under each inner rod 21, the inner rod 21 is moved from an inclined position to the horizontal position. After each push-pull rod 51 passes the horizontal position in the connecting base 52, each push-pull rod 51 is pulled down. The push-pull rod 51 drives the inner rod 21 of the top rod 2 to be pulled down and folded inwardly. As shown in FIG. 4, the inner rod 21 and the outer rod 22 are folded down. The retraction of the top rods 2 drives the vertical rods 1 to move inwardly, and the side rod assemblies 4 between the vertical rods 1 are simultaneously retracted inwardly. The link rod units 40 of each side rod assembly 4 are retracted inwardly. Due to the driving effect of the folding force of the top rods and the driving effect of each sliding seat 12, the vertical rods 1 are gradually moved inwardly, as shown in FIG. 6, until the vertical rods 10 are fully folded, so that the frame of the canopy tent is finally folded to the minimum volume, as shown in FIG. 10.

Figure 8:
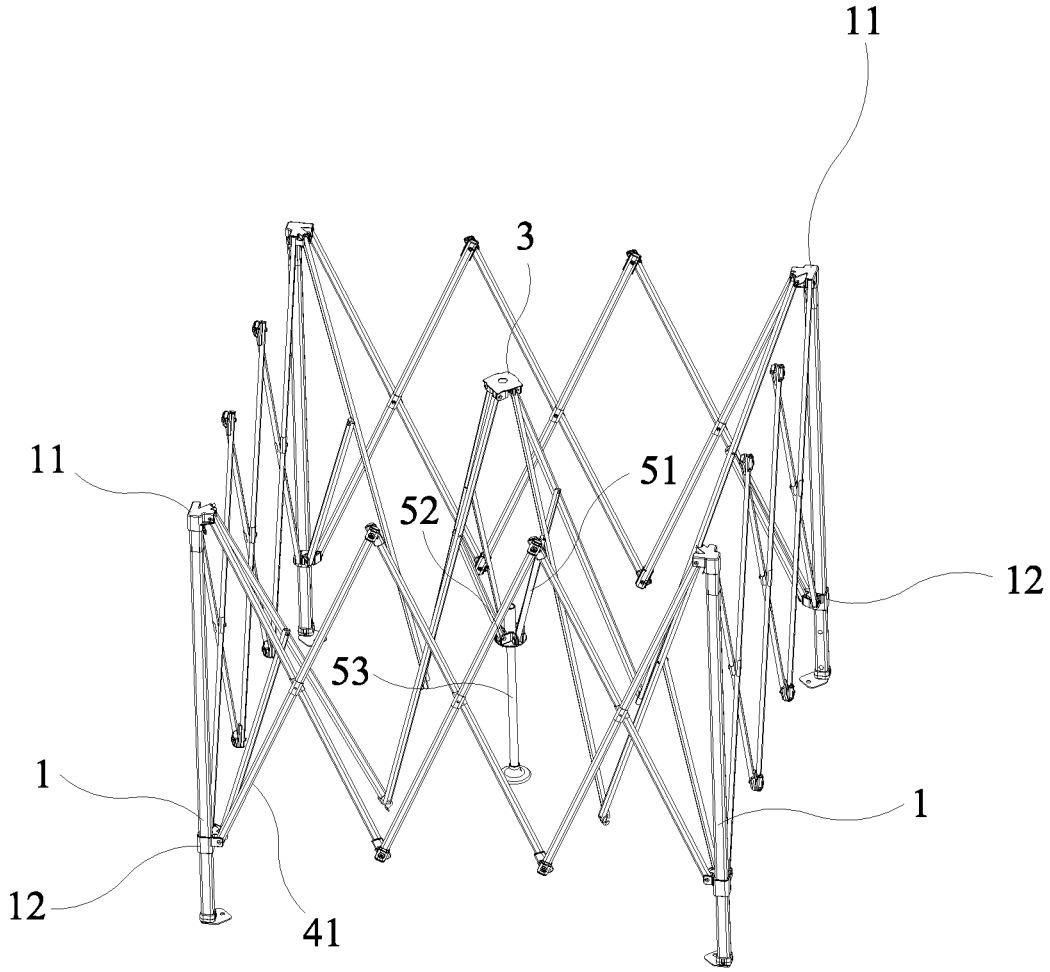
FIG. 8 is a schematic view of the present invention to be further folded.
Figure 9:
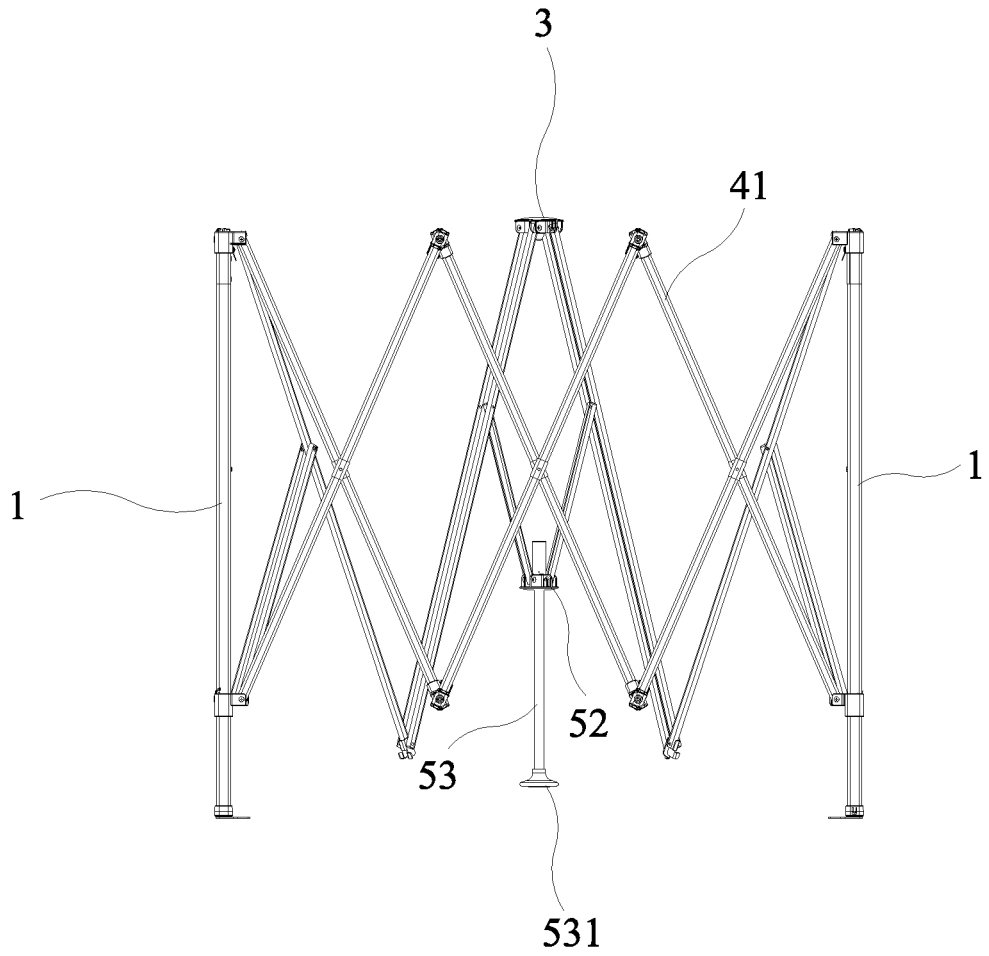
FIG. 9 is a side view of FIG. 8.

Conversely, when the canopy tent is to be unfolded for use, the vertical rods 1 of the canopy tent are pulled out a certain distance. As shown in FIG. 8, the vertical rods 1 are stretched out according to the demand. The connecting base 52 of the push-pull assembly 5 located at the middle of the canopy tent is pushed up. If the push-pull assembly 5 is provided with the pull rod 53, the pull rod 53 is pushed up. The upwardly moving connecting base 52 drives the push-pull rods 51 upward and outward, so that the top rods 2 are unfolded. When the top rods 2 are unfolded, they drive the vertical rods 1 to expand outward, and the side rod assemblies 4 between the adjacent vertical rods 1 also expand. The connecting base 52 continues to move up, and the inner rod 21 and the outer rod 22 of each top rod 2 are unfolded. When each push-pull rod 51 is pushed to the horizontal position, the push-pull rod 51 will move upward to be unfolded. All the push-pull rods 51 drive the connecting base 52 to rise to be in a balanced state supported under the inner rods 21. As shown in FIG. 2, the side rod assemblies 4 between the vertical rods 1 are also unfolded. After the canopy tent is unfolded, the sliding seats 12 on the vertical rods 1 are positioned.

The canopy tent of the present invention is provided with the push-pull assembly. The push-pull assembly is configured to be pulled down or pushed up to drive the connecting base at the center of the canopy tent to be pulled down or pushed up, so as to fold the push-pull rods downwardly, inwardly or unfold the push-pull rods upwardly. Pulling force and pushing force are generated from the top to drive the vertical rods to retract inwardly or expand outwardly. At the same time, the side rod assemblies connected between the vertical rods can be folded or unfolded, so that the overall canopy tent can be folded or unfolded. The canopy tent may quickly unfold or fold, thus conserving time and effort during operation. A single person may complete the unfolding and folding actions.

Although particular embodiments of the present invention have been described in detail for purposes of illustration, various modifications and enhancements may be made without departing from the spirit and scope of the present invention. Accordingly, the present invention is not to be limited except as by the appended claims.

I claim:

1. A canopy tent, comprising a plurality of vertical rods, top ends of the vertical rods being connected to top rods respectively, an inner end of each top rod being pivotally connected to a top hub located at a center of the canopy tent, each top rod comprising an inner rod and an outer rod that are pivotally connected to each other at a middle portion of each top rod, a side rod assembly that can be unfolded or folded inwardly being connected between every adjacent two of the vertical rods; a push-pull assembly being provided under the center of the canopy tent, the push-pull assembly including a plurality of push-pull rods that are pivotally connected to lower ends of the inner rods of the top rods respectively, a lower end of each push-pull rod being pivotally connected to a connecting base located under the top hub, each of the inner rods of the top rods being connected by a single one of the push-pull rods to the connecting base, wherein the single one of the push-pull rods has two opposite ends that are respectively and directly pivoted to the inner rod of the top rod and the connecting base;

wherein the push-pull assembly further includes a pull rod that extends through and is fixed to a middle portion of the connecting base such that the pull rod is movable in unison with the connecting base and an upper section and a lower section of the pull rod are rooted in the connecting base and extend in opposite directions of being toward and away from the top hub, respectively, wherein the upper section is unconstrained by and movable relative to the top rods, and wherein a lower end of the lower section of the pull rod is provided with a cover and the cover is spaced from the connecting base by the pull rod to be located below the connecting base to be adapted to be gripped by a user.

2. The canopy tent as claimed in claim 1, wherein the top rods are folded or unfolded by pulling the pull rod down or by pushing the pull rod up, so that the vertical rods are retracted inwardly or expanded outwardly, and the side rod assemblies between the vertical rods are folded or unfolded.

3. The canopy tent as claimed in claim 1, wherein the connecting base is provided with pivot notches corresponding to the push-pull rods, and the lower ends of the push-pull rods are pivotally connected to the pivot notches, respectively.

4. The canopy tent as claimed in claim 1, wherein a fixed seat is installed on the top end of each vertical rod, each vertical rod is provided with a sliding seat that is slidable along the vertical rod, an outer end of each top rod is pivotally connected to an inner side of the fixed seat, each side rod assembly includes at least two link rod units, each link rod unit includes two link rods that are hinged to each other and have an "X" shape when unfolded, and free outer ends of the link rods at two outer sides of each side rod assembly are hingedly connected to the fixed seats and the sliding seats of the adjacent vertical rods, respectively.

5. The canopy tent as claimed in claim 4, wherein an auxiliary rod is provided under the outer rod of each top rod, an upper end of the auxiliary rod is pivotally connected to the outer rod, and a lower end of the auxiliary rod is pivotally connected to an inner side of the sliding seat.

6. The canopy tent as claimed in claim 1, wherein the inner rod and the outer rod are pivotally connected by a one-way connecting member or a connecting plate, so that the inner rod and the outer rod can be unfolded and folded downward at the middle portion of each top rod.

7. The canopy tent as claimed in claim 1, wherein the vertical rods are telescopic rods.

* * * * *